US006199481B1

(12) United States Patent
Aoki

(10) Patent No.: US 6,199,481 B1
(45) Date of Patent: Mar. 13, 2001

(54) POWER FEEDER APPARATUS FOR ROTARY SHAFT IN PRINTING PRESS

(75) Inventor: Takatsugu Aoki, Shizuoka (JP)

(73) Assignee: Shinohara Machinery Co., Ltd. (JP)

( * ) Notice: Subject to any disclaimer, the term of this patent is extended or adjusted under 35 U.S.C. 154(b) by 0 days.

(21) Appl. No.: 09/434,426

(22) Filed: Nov. 4, 1999

(51) Int. Cl.[7] ..... B41F 13/24
(52) U.S. Cl. ..... 101/248; 101/216
(58) Field of Search ..... 101/181, 183, 101/212, 216, 248, 485, 486

(56) References Cited

U.S. PATENT DOCUMENTS 5,249,522 * 10/1993 Kusch et al. ..... 101/248
5,357,860 * 10/1994 Shibata et al. ..... 101/248
5,410,959 * 5/1995 Sugiyama et al. ..... 101/230
5,720,222 * 2/1998 Reichardt et al. ..... 101/248
5,771,805 * 6/1998 Branas et al. ..... 101/248
5,924,362 * 7/1999 Volz et al. ..... 101/183

FOREIGN PATENT DOCUMENTS 4140013 6/1993 (DE) .

* cited by examiner

*Primary Examiner*—Ren Yan
(74) *Attorney, Agent, or Firm*—Ladas and Parry

(57) ABSTRACT

Power feeder apparatus for a rotary shaft of a printing press having a circuit substrate 22 with concentric circular circuits 24 whose centers coincide with an axis of rotary shaft 10 and provided at the tip end of the shaft 10 on which electric appliances can be mounted. A support substrate 36 with elastic contacts 42 in correspondence with the circular circuits 24, is slidably provided at the stationary side of the apparatus in opposed relationship to the circuit substrate 22. An actuator 50 serves for moving the support substrate 36 in the direction of the circuit substrate 22.

5 Claims, 5 Drawing Sheets

POWER FEEDER APPARATUS FOR ROTARY SHAFT IN PRINTING PRESS

BACKGROUND OF THE INVENTION

1. Field of the Invention

The present invention relates generally to a sheet-fed printing press, or more precisely, to a power feeder apparatus for a rotary shaft such as a plate cylinder shaft of the printing press.

2. Description of the Prior Art

In order to correct the position of a printing plate and thus to effect register adjustment by electric driving means such as a motor incorporated in a plate cylinder, it is necessary to supply power at will from a still machine side to a plate cylinder shaft which is rotating at high speed. The term "power" used herein includes a relatively large current for driving the motor as well as a relatively small control current for controlling a potentiometer fitted to the motor.

In German patent laid-open DE 4140013 by the same applicant as in the present application, a power feeder apparatus for a rotary shaft is disclosed which comprises, as shown in FIG. 5, a rotary cylinder 104 with many slip rings 100 formed on the outer periphery thereof for electrically connecting with the rotary shaft 102; a fixed casing 106 so disposed as to surround the rotary cylinder 104; and a large number of canti-lever brushes 108 extruded from the fixed casing 106 for controllably bringing into contact with the slip rings 100.

However, such brush ring type apparatus is high in cost, because forming the slip rings on the periphery of the rotary cylinder is difficult. The rotary cylinder is somewhat long enough in the axial direction of the rotary shaft and occupies a large space. In addition, there arise sometimes errors in signal transmission due to the weak spring force of the cantilever brushes.

SUMMARY OF THE INVENTION

In view of the above-described problems of the prior art technique, the present invention provides an improved power feeder apparatus for a rotary shaft and aims at reducing the cost of production, and providing a compact apparatus, while furthermore, securing a stable electrical contact.

In accordance with the present invention, the power feeder apparatus comprises a circuit substrate with cocentric circular circuits whose centers coincide with an axis of the rotary shaft and provided at a tip end of the shaft 10; a support substrate 42 with elastic contacts 42 in correspondence with the circular circuits and slidably provided at the stationary side of the apparatus in opposition to the circuit substrate 22; and actuator means 50 for moving the support substrate 22 in the direction of the circuit substrate 22.

Only when power feeding is needed, actuator means moves the support substrate towards the circuit substrate. Then, a plurality of elastic contacts provided on the support substrate come into contact with the corresponding cocentric circular circuits of the circuit substrate.

Electric connection can be obtained, regardless of the rotational phase of rotary shaft 10, as the center of the circuits coincides with the axis of the rotary shaft.

These and other objects of the invention will become apparent from the following description with reference to the drawings. But, these show merely an embodiment of the invention.

DESCRIPTION OF THE PREFERRED EMBODIMENT

Figure 1:
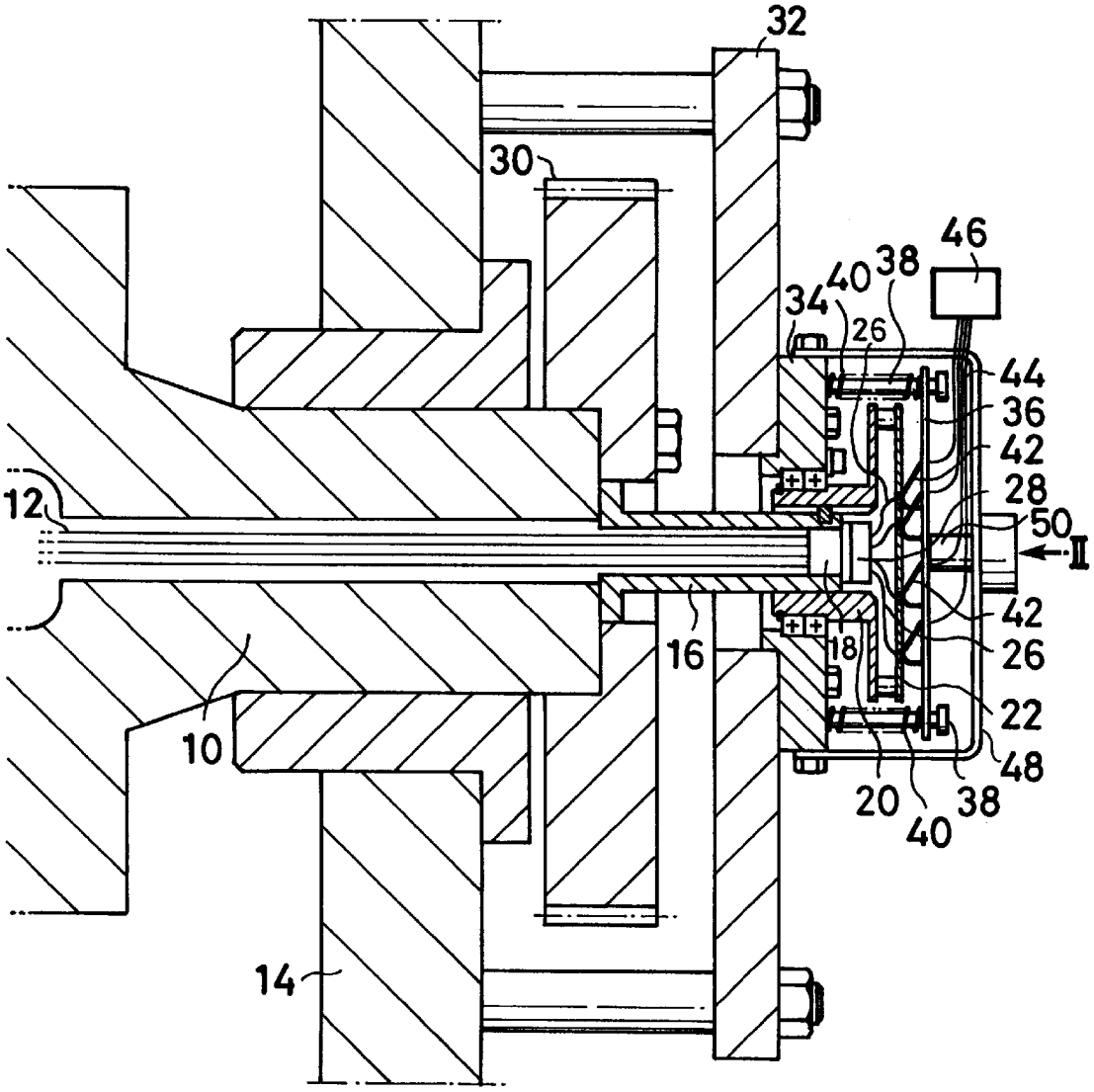
FIG. 1 is an explanatory sectional view, showing an embodiment of power feeder apparatus according to the present invention.

Referring now to FIG. 1, numeral 10 indicates a rotary shaft of a plate cylinder to be electrically supplied. As described, drive current as well as control current are needed for electric appliances such as a motor mounted on the rotary shaft 10 for register adjustment. The electric appliances, though not shown, are mounted on the plate cylinder. Lead wires 12 serve for supplying electric current to the appliances.

Rotary shaft 10 is, freely supported by a pair of side frames 14 of the printing press and continuously rotated for print production at 12,000 rph or so.

Connecting cylinder 16 is attached to the tip end of rotary shaft 10, with its axis coincident with that of rotary shaft 10, and a connector 18 is provided at the end at connector 18. Attachment 20 coupled with the connecting cylinder 16 supports a planar circuit substrate 22 in conjunction with connecting cylinder 16 and rotary shaft 10.

Figure 2:
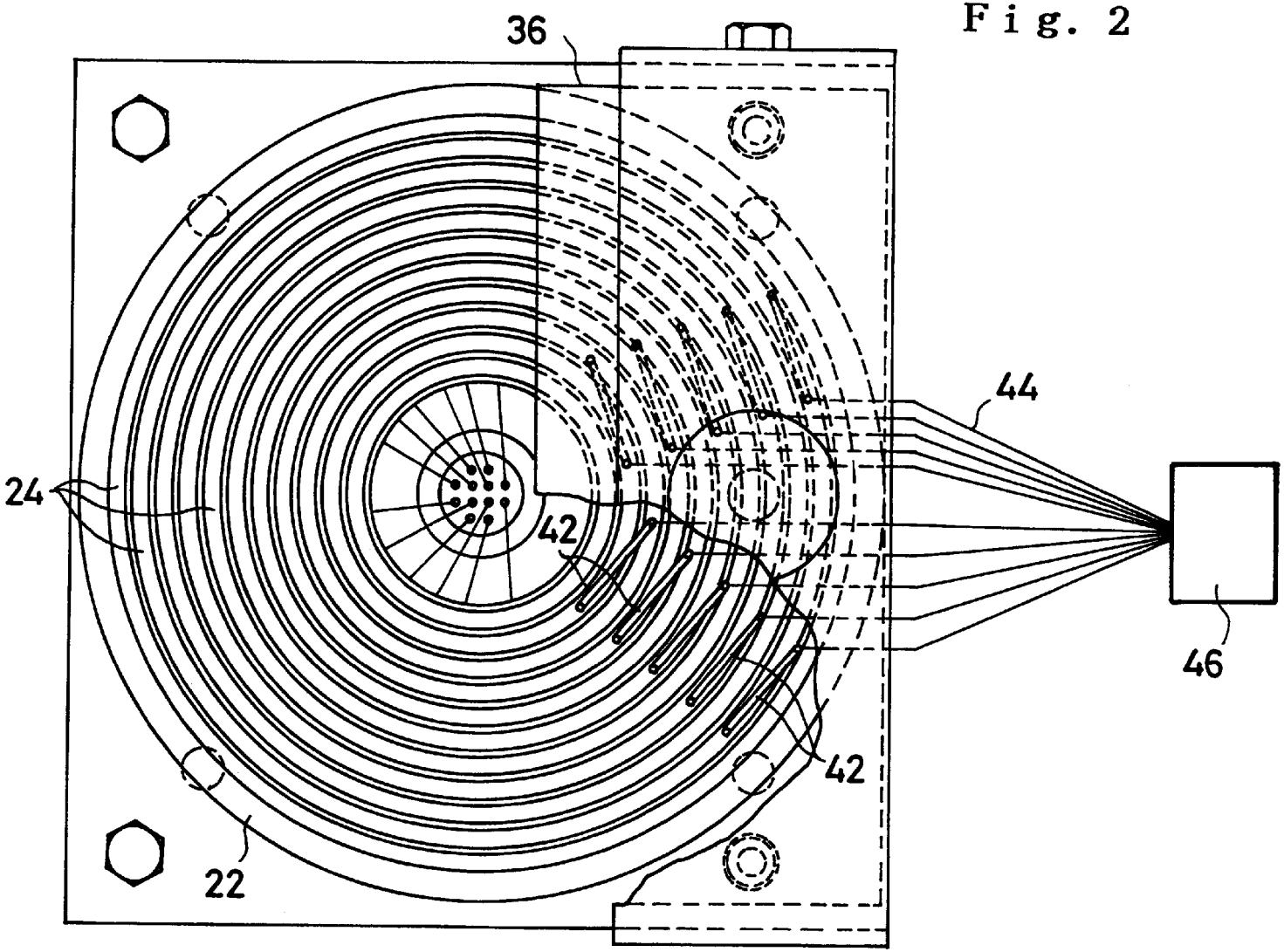
FIG. 2 is a front view from the line seen in the direction of arrow II in FIG. 1.

As shown in FIG. 2, a multitude of concentric stripes of circuits 24 are lined on the circuit substrate 22 and the centers of cocentric stripes coincide with that of rotary shaft 10. Such circuit substrate 22 can be inexpensively manufactured by conventional print circuit production methods. Each cocentric circuits 24 is electrically connected with the connector 18 of rotary shaft 10 by way of lead wires 26 and connector 28.

The planar circuit substrate 22 is orthogonal to the axial line of rotary shaft 10 and the centers of concentric circuits 24 on the circuit substrate 22 coincide with the axial center of rotary shaft 10.

Connecting cylinder 16 and attachment 20 are only for designing conveniences. The circuit substrate 22 may directly be attached to the tip end of rotary shaft 10. But, the connecting cylinder 16 and attachment 20 are provided for convenience sake, as drive gear 30 is fixed to the rotary shaft 10.

The present invention aims at feeding electric power at will from the stationary machine side. Bracket 32 and support member 34 are fixed to stationary side frame 14.

Guide pins 38 for guiding a support substrate 36 are extended on the support member 34 in the axial direction of rotary shaft 10. Support substrate 36 is planarly opposed to the circuit substrate 22 and slidably supported by a plurality of guide pins 38. The support substrate 36 is thrust to the right in FIG. 1 by springs 40 of guide pins 38.

As shown in the figures, a plurality or elastic contacts 42 extend in the direction of circuit substrate 22 in correspondence with the circuits 24. These elastic contacts 42 are made of conductive metal such as beryllium copper with gold plating on them. The elastic contacts 42 make reliable and soft contact with the print circuits 24 on the circuit substrate 22. The elastic contacts 42 are electrically connected with electric source (not shown) by way of lead wires 44 and connector 46. In place of guide pins 38, sliding rails may be used for guiding the support substrate 36 in planar opposition to the circuit substrate 22.

Figure 3:
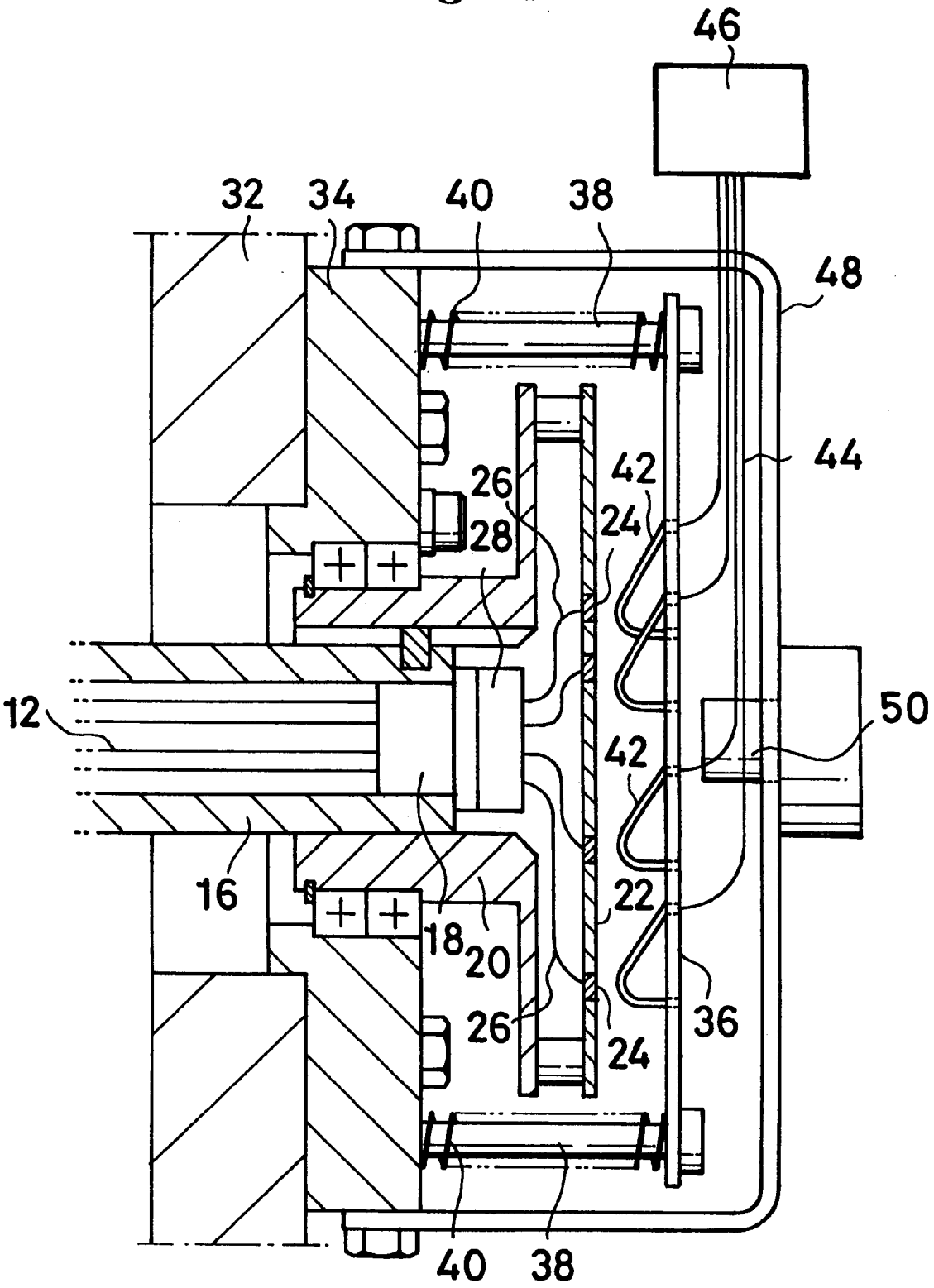
FIG. 3 is an enlarged partial section of FIG. 1, showing non-transmitting state.
Figure 4:
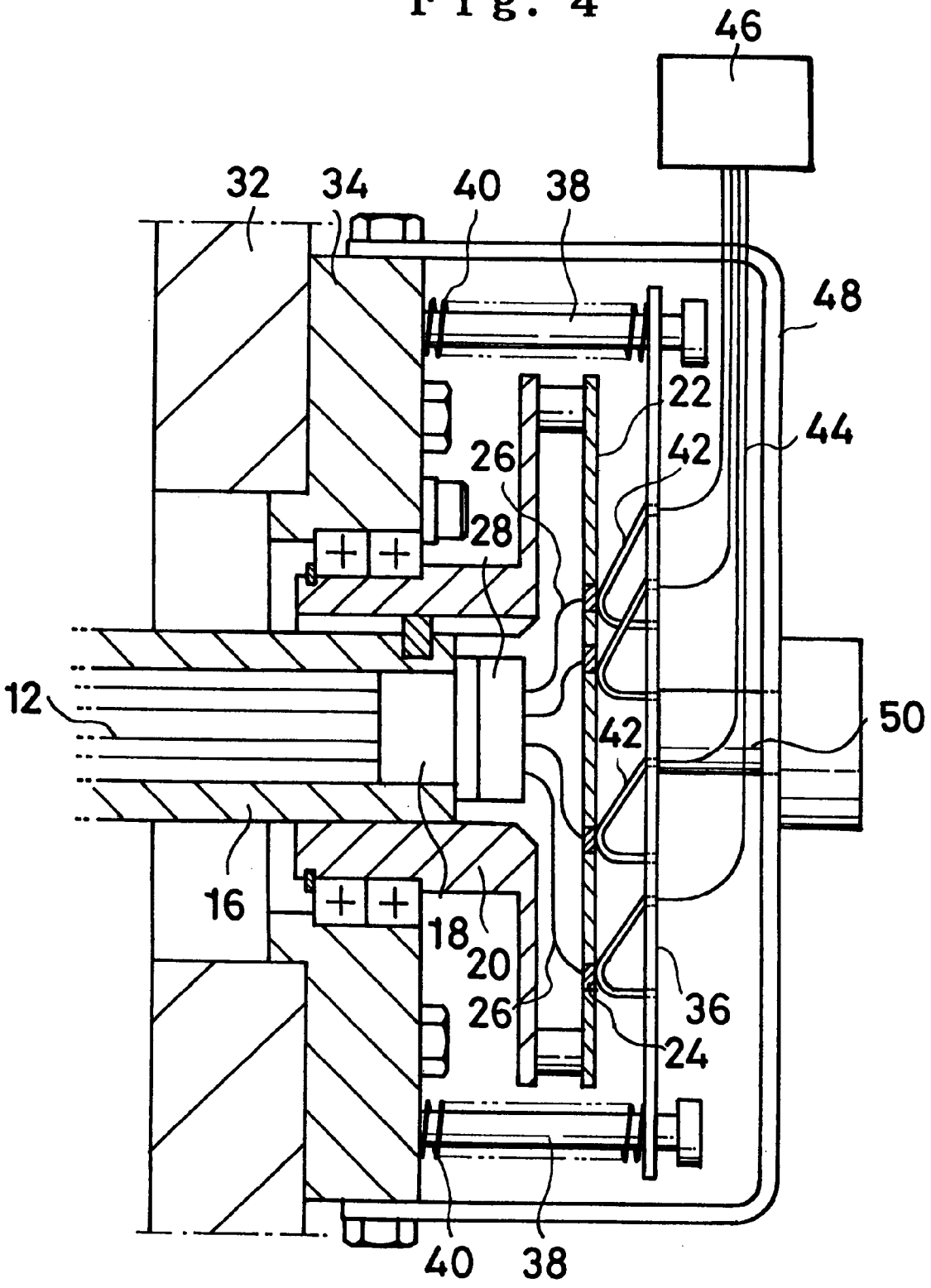
FIG. 4 is a similar enlarged section of FIG. 1, showing transmitting state.
Figure 5:
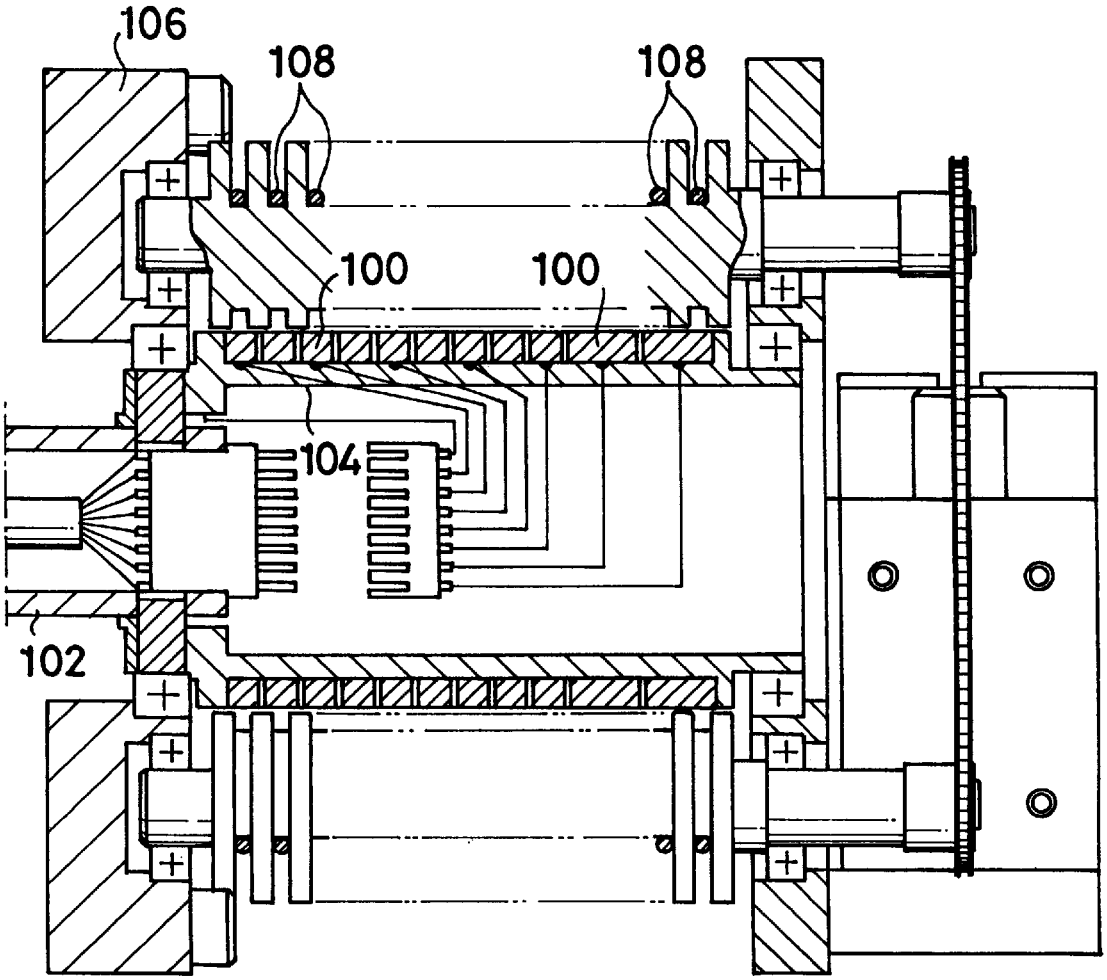
Fig. 5 Prior Art
FIG. 5 is an explanatory sectional view of prior art.

Referring again to the figures, a casing 48 is fixed onto a stationary support member 34 and actuator means 50, for example, air cylinder is provided. Against the thrust of springs 40, actuator means 50 moves the support substrate 36 guided by pins 38 in the direction of circuit substrate 22. Electric connection between the elastic contacts 42 and circuits 24 is switched on and off by the movement of support substrate 36, as shown in FIGS. 3 and 4. An air cylinder is suitable for the actuator means, because it is small, anti-explosive and excellent in responsiveness However, other means may well be used as long as it can overcome the springs 40.

According to the present invention, the cost of production can be sharply reduced, because the circuit substrate on the rotary shaft is made as a planar print board. The apparatus is extremely compact, as it consists of two substrates in opposed relationship to each other and because the actuator means, doesn't require space in the axial direction of the rotary shaft. High contact pressure as well as stable electric connection can be obtained due to the intentional thrusting of the contacts produced by actuator means.

The present invention is not limited to the embodiment described hitherto. Various changes and modifications can, of course, be made without departing from the spirit thereof.

What is claimed is:

1. Power feeder apparatus for a rotary shaft comprising:

a circuit substrate 22 including concentric circular circuits 24 having centers which coincide with an axis of a rotary shaft 10 on which an electric appliance can be mounted, said circuit substrate being provided at a tip end of said rotary shaft;

a support substrate 36 having elastic contacts 42 in correspondence with said circular circuits 24 and slidably provided in opposed relationship with said circuit substrate 22; and actuator means 50 for moving said support substrate 36 in the direction of said circuit substrate 22.

2. Power feeder apparatus as claimed in claim 1, comprising spring means acting on said support substrate to urge the support substrate away from said circuit substrate.

3. Power feed apparatus as claimed in claim 1, wherein said actuator means comprises an air cylinder.

4. Power feeder apparatus as claimed in claim 1, comprising a plurality of lead wires 44 respectively connected to said elastic contacts 42 for supplying electrical power thereto, and a plurality of further lead wires 12 respectively connected to said circular circuits 24 for supplying electrical power to the electric appliance when said elastic contacts are in contact with said circular circuits.

5. Power feeder apparatus as claimed in claim 1, wherein said circuit substrate comprises a print board.

* * * * *